US005210468A

United States Patent [19]

Yoshioka

[11] Patent Number: 5,210,468

[45] Date of Patent: May 11, 1993

[54] GAS-DISCHARGE DISPLAY ELEMENT DRIVEN BY USING SEED DISCHARGE

[75] Inventor: Toshihiro Yoshioka, Tokyo, Japan

[73] Assignee: NEC Corporation, Tokyo, Japan

[21] Appl. No.: 617,206

[22] Filed: Nov. 23, 1990

[30] Foreign Application Priority Data

Nov. 22, 1989 [JP] Japan ..... 1-304293
Jul. 27, 1990 [JP] Japan ..... 2-199653

[51] Int. Cl.[5] ..... G09G 3/10; H01J 17/49

[52] U.S. Cl. ..... 315/169.4; 313/585; 313/485; 313/621; 313/622; 340/772; 340/773; 340/775

[58] Field of Search ..... 315/169.4; 313/584, 313/585, 485, 621, 622; 340/772, 773, 774, 775

[56] References Cited

U.S. PATENT DOCUMENTS 3,157,824 11/1964 Jones ..... 340/774
3,886,404 5/1975 Kurahashi et al. ..... 340/775
3,925,703 12/1975 Schermerhorn ..... 340/775
4,737,687 4/1988 Shinoda et al. ..... 315/169.4

OTHER PUBLICATIONS

Lamoureux, "Auto Pilot", IBM Technical Disclosure Bulletin, vol. 15, No. 8, Jan. 1973,pp. 2514–2515.

Baskin, "AC Gas Panel with Sustaining Electrodes on a single Plane" IBM Technical Disclosure Bulletin, vol. 19, No. 2, Jul. 1976 pp. 703–704.

"Logically Addressable Surface Discharge ac Plasma Display Panels with a new Write Electrode": SID 84 Digest; 1984.

"High-Efficiency, High-Luminance Gas-Discharge Mode for Color TV Display": Japanese Journal of Applied Physics; vol. 26, No. 7 Jul., 1987, pp. L1100–L1103.

"An intense and efficient source of vacuum ultraviolet radiation: Low-pressure Xe Townsend discharge": Journal of Applied Physics, vol. 58, No. 10, Nov. 1985.

*Primary Examiner*—Robert J. Pascal
*Assistant Examiner*—Michael B. Shingleton
*Attorney, Agent, or Firm*—Leydig, Voit & Mayer

[57] ABSTRACT

In a gas discharge display element according to the present invention, two pairs of electrodes are arranged in a discharge space of a display cell and one of the electrode pairs which forms a first discharge space between the first electrodes is driven such that discharge having a memory function and capable of being memory-driven is produced during a time in which light emission of the display cell is sustained. The other electrode pair is driven with a voltage pulse having duration smaller than that of the driving voltage pulse for the first electrode pair such that discharge a is obtained in the other space defined between the electrodes of the other electrode pair using the discharge in the first space as a seed discharge. The duration of the drive pulse for the second electrode pair preferably terminates before the discharge current is reduced due to the formation of a wall charge.

17 Claims, 8 Drawing Sheets

GAS-DISCHARGE DISPLAY ELEMENT DRIVEN BY USING SEED DISCHARGE

BACKGROUND OF THE INVENTION

1. Field of the Invention

The present invention relates to a gas-discharge display element. In particular, the present invention relates to such a gas-discharge display element having high luminance and high efficiency characteristics necessary for a display device which uses such elements and is capable of a tonal display.

2. Description of the Related Art

A gas-discharge display element or device is generally classified as an AC type and a DC type depending upon structure and driving system thereof. In either type, an electric discharge is generated in a discharge space around a selected image element thereof by applying, to gas filling a discharge space thereof, an electric field strong enough to start a discharge and Light emission is sustained by repeating such discharges.

FIG. 1A is a plan view of a conventional AC type gas-discharge display element and FIG. 1B is a cross section thereof taken along a line X-Y in FIG. 1A. The gas-discharge element includes a glass substrate 1, a pair of electrodes 4 formed thereon, a lamination of an $Al_2O_3$ layer 5 and a MgO layer 6 covering the electrodes 4 and a front glass plate 10 opposing the lamination through a partition wall 7 provided on the lamination. On a lower surface of the glass 10, a write electrode 9 and an $Al_2O_3$ layer 12 are formed in that order and a phosphor 8 is provided on a lower surface of the $Al_2O_3$ layer 12 at a position opposing the electrodes 4.

In this AC type gas-discharge display element, an AC voltage having rectangular waveform is applied across the electrodes 4 arranged in a common plane and covered by dielectric member to generate and sustain an electric discharge between the electrodes. Phosphor 8 is excited by ultraviolet light produced in a discharge space 16 formed in an area defined by these electrodes 4 to provide a color display.

The generation and sustaining of the discharge is usually performed while an AC sustaining voltage pulse is supplied continuously from a power source 13 to the electrodes 4. To perform a writing, a write pulse is applied from a power source 15 to the electrode 9 in an interval between sustaining pulses of the sustaining pulse train or with the writing pulse added to the sustaining pulse. To perform an erasing, an erase pulse signal is applied from the power source 15 to the electrode 9 in the interval between the sustaining pulses. A memory mode operation of the element is performed by using same sustaining pulse within a time when the display element sustains light emission.

There are other AC type gas-discharge elements, such as a gas-discharge element operating not in memory mode but in line sequence mode and a gas-discharge element having a pair of electrodes 4 formed on opposing substrates.

In these pulse drive gas-discharge display elements, light emission intensity is modulated by controlling the number of pulses applied to selected electrodes within unit time to thereby control the number of light emissions.

Such an AC type gas-discharge display element has a sufficient memory function due to the fact that electric charge is accumulated in a dielectric layer on the electrodes. That is, a cell, once discharge is started, can sustain a discharge at a voltage Vs even lower than the discharge start voltage Vf. This memory capability can be very effectively used when the number of pixels or elements in a gas-discharge display panel as a display device is to be increased.

A substantial amount of ultraviolet light is produced by the gas-discharge in the gas-discharge display element with an early half duration of discharge current caused by gas-discharge. In order to utilize this highly efficient light emission, it is effective to drive the element with voltage pulses having small width. However, such drive with short pulses may cause an increase in the characteristic discharge voltage and a decrease of memory margin (Vf-Vs). When considering an improvement of element characteristics, these two effects appear simultaneously. Therefore, driving with short pulses is difficult and thus it is impossible to improve efficiency of light emission.

In FIG. 2, Vf is discharge start voltage, Vs is minimum discharge sustain voltage and M is memory coefficient $(=(Vf-Vs)/2Vs)$ of a conventional element.

As mentioned, the conventional gas discharge display element is insufficient in light emitting characteristics, in particular, in efficiency of ultraviolet light emission for color display. Further, the modulation of light emission strength by controlling the number of emissions is not easy and it is very difficult to display multicolor tone.

SUMMARY OF THE INVENTION

An object of the present invention is to provide a gas-discharge display element capable of being driven stably with high efficiency.

A gas-discharge display element according to the present invention comprises a first substrate, a second substrate formed above the first substrate with a predetermined space therebetween, a pair of first electrodes formed on the first substrate, a first dielectric film formed on the first electrodes and on the first substrate, a pair of second electrodes formed on the first dielectric film in the vicinity of the first electrodes, a second dielectric film covering the second electrodes, discharge gas filling a space between the first and second substrates, a phosphor member formed on a portion of a lower surface of the second substrate opposing the first and second electrodes pairs, first power supply means connected to the first electrode pair and second power supply means connected to the second electrode pair.

Preferably, the gas-discharge display element according to the present invention further comprises an electrode formed on the lower surface of the second substrate, a third dielectric film formed between the electrode and the phosphor member and third power supply means connected to the electrode.

The first power supply means preferably comprises means for supplying a first voltage pulse to the first electrode pair, by which a discharge produced between the first electrodes indicates "a memory characteristic", and the second power supply means preferably comprises means for supplying to the second electrodes a second voltage pulse whose width is shorter than that of the first voltage pulse and by which a discharge is produced between the second electrodes utilizing the discharge indicating memory characteristics as a seed discharge.

Preferably, the second voltage pulse has a width shorter than a time period during which discharge current between the second electrodes is reduced due to formation of a wall charge.

Preferably, the second power supply means comprises means for controlling magnitude of the second voltage pulse. The third power supply means preferably comprises means for supplying write and erase pulses to the electrodes. The second power supply means preferably comprises means for controlling the magnitude of the second voltage pulse. The first electrode pair has an area which is preferably smaller than that of the second electrode pair.

The pulse width of the first voltage pulse is preferably 1 to 2 μsec and that of the second voltage pulse is preferably 0.2 to 1 μsec. The distance between the first electrodes is preferably 0.01 to 0.1 mm, the first voltage pulse is preferably 100 to 180 V, the distance between the second electrodes is preferably 0.05 to 0.4 mm and the second voltage pulse is preferably 100 to 180 V. The second voltage pulse is supplied with a delay of preferably 0.2 to 0.8 μsec from the first voltage pulse.

The width of the write pulse is preferably 1 to 5 μsec and that of the erase pulse is preferably 0.2 to 1 μsec. The distance between the first and second substrates is preferably 0.1 to 0.2 mm, the write pulse voltage is preferably 150 to 250 V and the erase pulse voltage is preferably 150 to 250 V.

When there is discharge within or in the vicinity of a main discharge space defined between a pair of main discharge electrodes prior to or during an application of voltage across the electrodes, main discharge is easily produced in the space by the voltage application, using the existing discharge as a seed discharge. Therefore, by forming the first electrode pair (seed discharge electrode pair) in the vicinity of the second electrode pair (main discharge electrode pair) which is driven by short pulse, and by producing a discharge with a short voltage pulse between the main discharge electrodes utilizing the discharge from the seed discharge electrode pair as a seed discharge, an increase in the characteristic discharge voltage between the main discharge electrodes is prevented, as shown in FIG. 2. A hatched portion in FIG. 2 shows a range of drive voltages controllable by on-off operation of the short pulse drive discharge and the seed discharge. That is, a main discharge can be started when a voltage not less than V'f is applied to the main discharge electrodes while a seed discharge is sustained. When the voltage is not higher than Vs, the main discharge is extinguished by extinction of seed discharge because the main discharge has no memory function. Therefore, when the main discharge electrodes are driven by a voltage within this range while a seed discharge having a memory function exists, low voltage, short pulse driving of the element becomes possible with memory capability. That is, it is possible to achieve a stable memory drive and a highly efficient light emission by providing two pairs of electrodes, utilizing one pair for seed discharge formation and driving the other pair with a short pulse to form main discharge. With the use of such a seed discharge, the linearity of voltage dependency of light emission caused by the main discharge is improved compared with the case without the use of such a seed discharge, and light emission strength can be modulated easily by the drive voltage, so that a multi-tone display becomes possible. This effect can be used even when the short pulse drive is not used.

By arranging such gas discharge display elements in a matrix, a flat, thin gas discharge display panel providing sufficient display quality and having sufficient drive characteristics can be provided.

BRIEF DESCRIPTION OF THE DRAWINGS

The above and other objects, features and advantages of the present invention will become more apparent from the following detailed description taken in conjunction with the accompanying drawings, wherein.

DESCRIPTION OF THE PREFERRED EMBODIMENTS

Figure 3A:
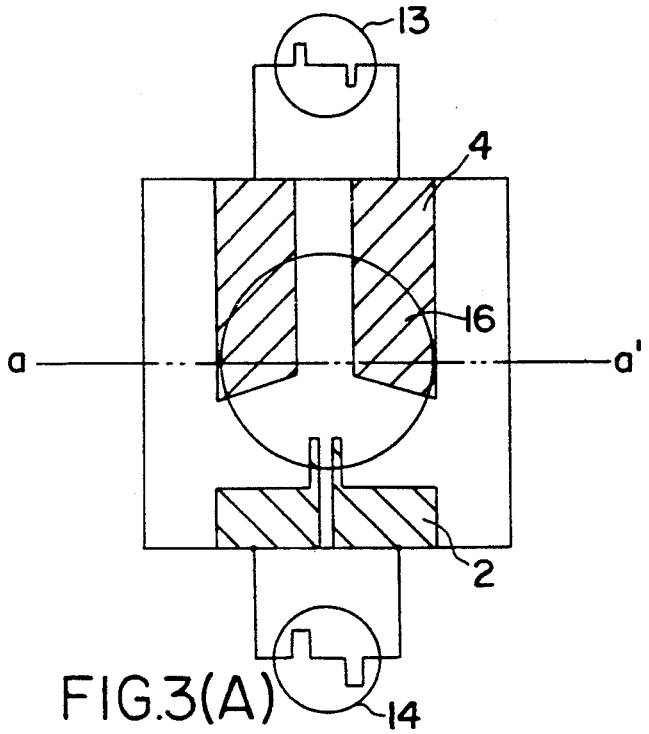
FIG. 3A is a plan view illustrating an embodiment of the present invention.
Figure 3B:
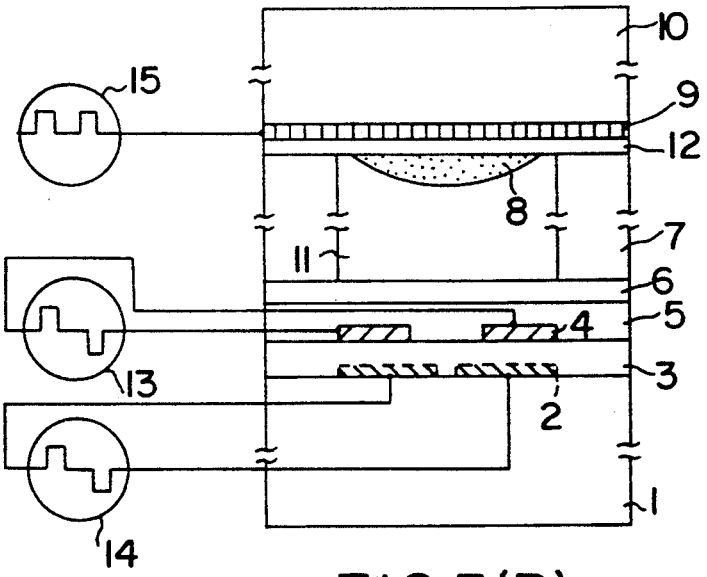
FIG. 3B is a cross section taken along a line a—a' in FIG. 3A.
Figure 4A:
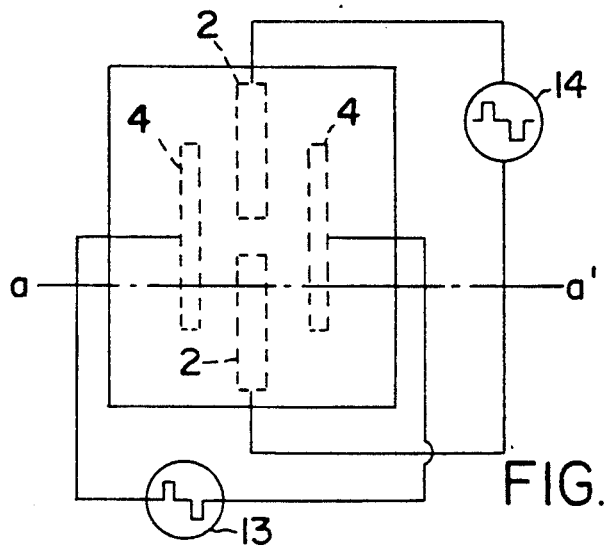
FIG. 4A is a plan view illustrating another embodiment of the present invention.
Figure 4B:
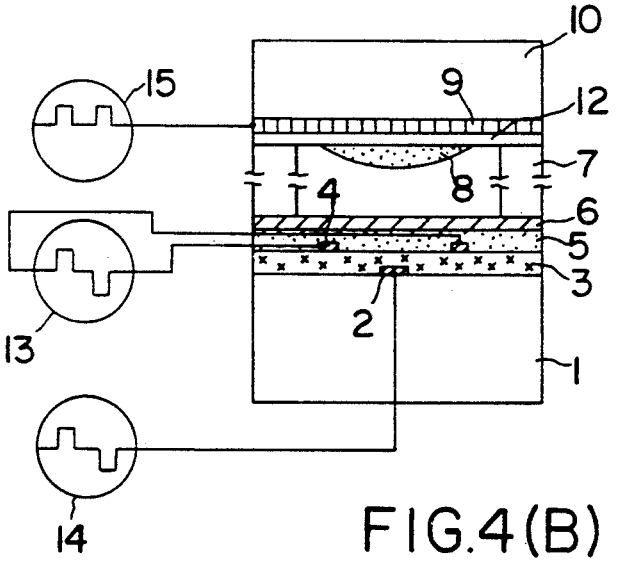
FIG. 4B is a cross section taken along a line a—a' in FIG. 4A.

FIG. 3A is a plan view illustrating an arrangement of electrodes of an embodiment of a gas discharge display element according to the present invention and FIG. 3B is a cross section taken along a line a—a' in FIG. 3A. For simplicity of explanation, the gas discharge display element will be described as being an AC type. On a glass substrate 1, a pair of aluminum seed discharge electrodes 2 each 0.05 mm wide are formed, defining seed discharge space therebetween, using vacuum evaporation and lithography techniques. An $Al_2O_3$ layer 3 is formed to 2 μm thick on electrodes. A pair of main discharge electrodes 4 of aluminum each of 0.2 mm wide is formed on the layer 3 to define a main discharge space therebetween and an $Al_2O_3$ layer 5 is formed on the main discharge electrodes 4 similarly to the layer 3. On the $Al_2O_3$ layer 5, a MgO layer 6 of 1 μm thick is formed. Then, on the layer 6, a partition wall 7, 0.25 mm high is formed using thick film techniques. Finally, a front glass 10 having a lower surface on which an aluminum write electrode 9 and an $Al_2O_3$ layer 12 are formed in that order, phosphor 8 is painted on the layer 12, adhered to the partition wall with a gap of 0.3 mm, and the gap is filled with discharge gas 11 of He-Xe(2%) mixture at 80 to 500 torr. Thus, an AC surface discharge type gas discharge display element is formed. In this case, the MgO layer 6 is used to reduce the discharge voltage since MgO has a high efficiency secondary electron emission when by bom barded ions, and the $Al_2O_3$ layer 5 is used to increase the breakdown voltage of the dielectric. Instead of the construction shown in FIGS. 3A and 3B, a construction such as shown in FIGS. 4A and 4B can be used in which seed electrodes 2 are arranged such that electric field formed thereby is orthogonal to that formed by main discharge electrodes 4.

Figure 1A:
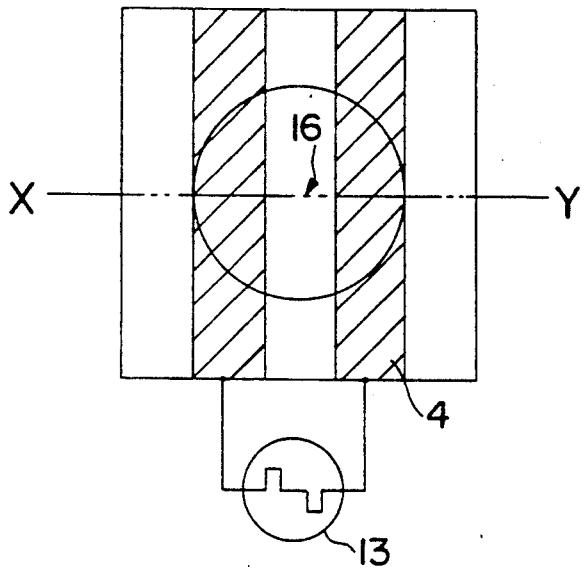
FIG. 1(A) PRIOR ART
FIG. 1A is a plan view of a conventional gas discharge display element.
Figure 1B:
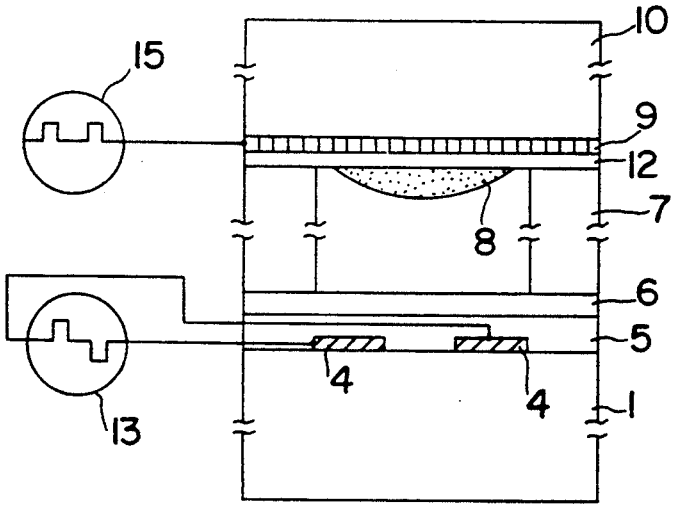
FIG. 1(B) PRIOR ART
FIG. 1B is a cross section taken along a line X-Y in FIG. 1A.
Figure 2:
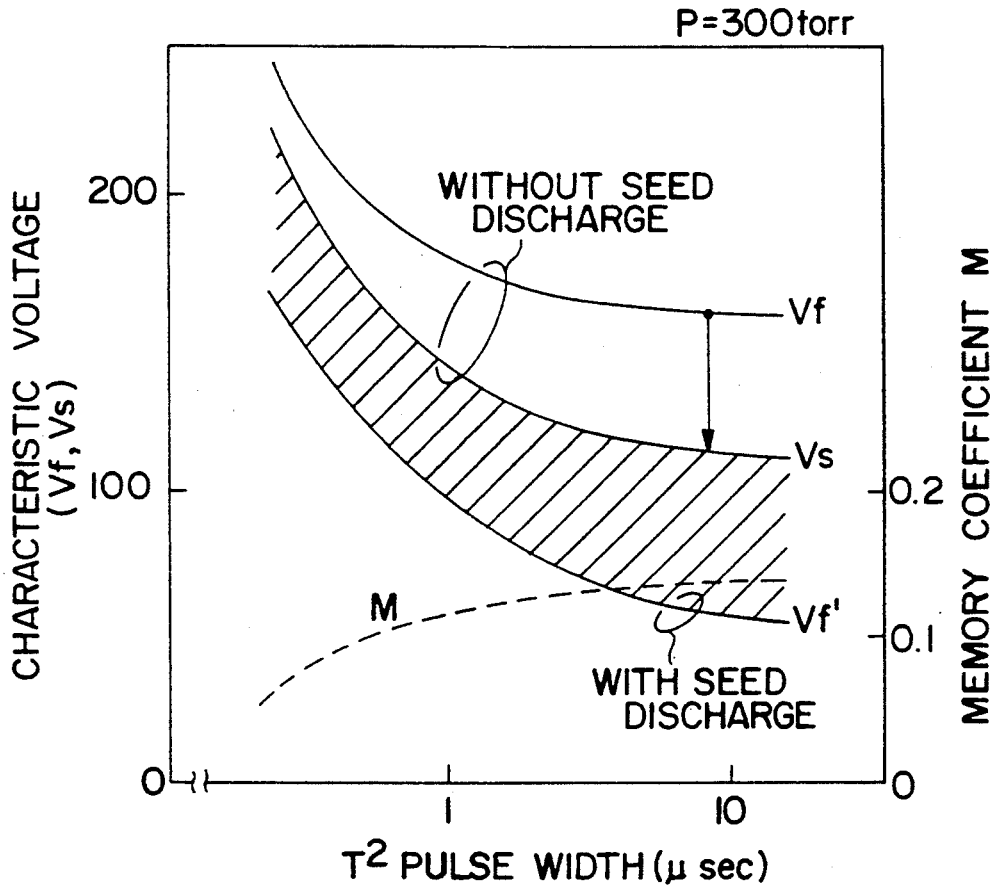
FIG. 2 is a graph showing the pulse width dependency on characteristic voltage.
Figure 5:
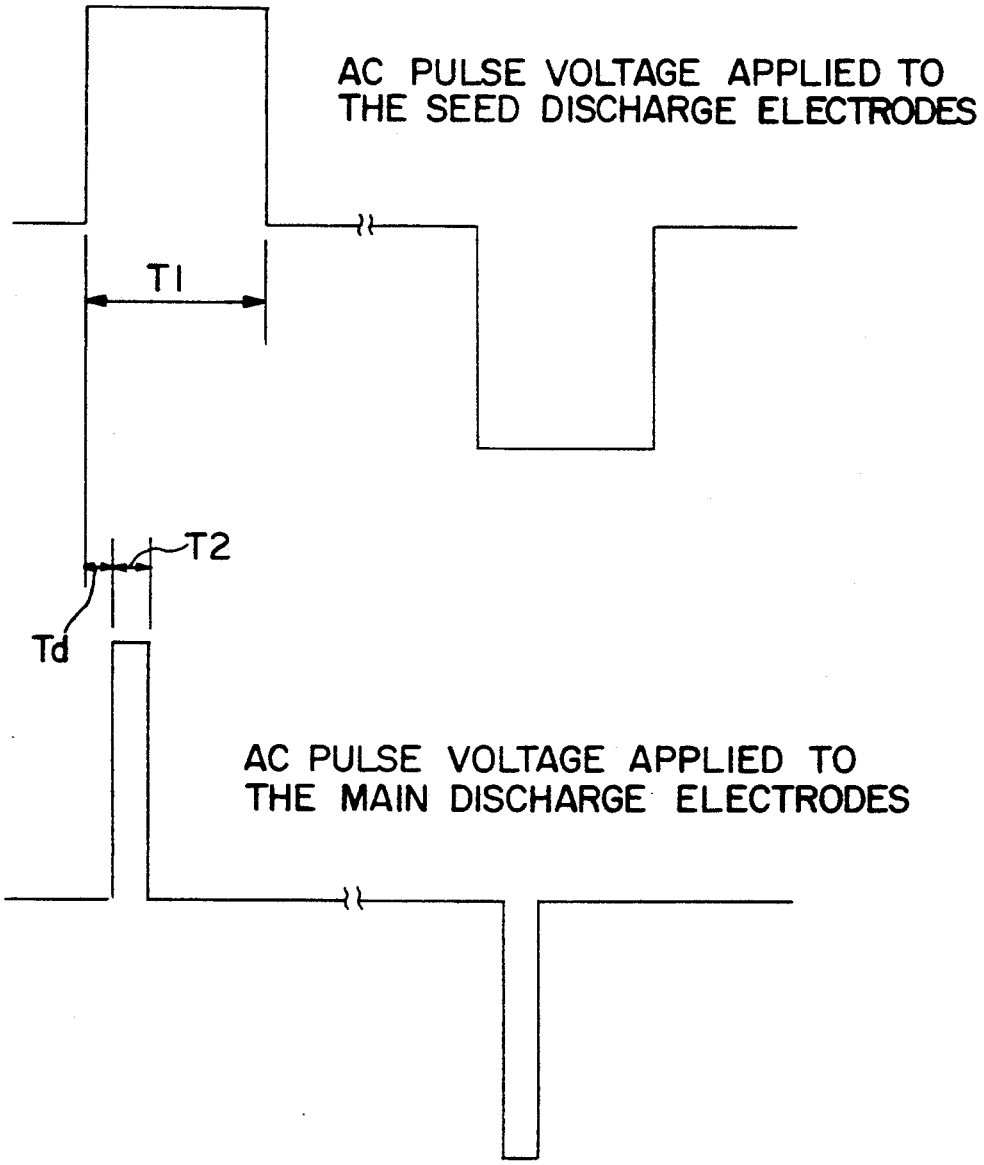
FIG. 5 is a timing chart explaining a method of driving embodiments of the present invention.

In order to directly evaluate discharge-caused ultraviolet light emission from the element, a similar element to this except that, in lieu of the front glass 10, a plate of magnesium fluoride having no phosphor painted thereon was also prepared. Further, for comparison purpose, a gas discharge display element such as shown in FIG. 1 was also prepared. A light emission characteristics of the gas discharge display element was measured by applying a 20 kHz AC pulse voltage 2 μsec wide from a power source 14 to the seed electrodes 2 and a 20 kHz AC pulse voltage 0.2 to 5 μsec wide from a power source 13 to the main discharge electrodes 4, at a timing shown in FIG. 5. Emission efficiency was measured as a ratio of light output to supply power to the element. The result is shown in FIG. 2.

The characteristics of the seed discharge and the effect thereof on the main discharge were evaluated using an element shown in FIG. 3 and having the seed discharge electrodes 2 in the vicinity of the main discharge electrodes 4. To the electrodes 2 from which seed discharge is produced, an AC pulse voltage was applied with a pulse width of time T1. When T1 is shorter than about 2 μsec, the seed discharge exhibited an efficient memory capability. When a pulse voltage of width T2 is applied to the main discharge electrodes 4 at a time delayed by Td, which is shorter than the seed discharge time T1 (about 0.1 to 1 μsec), from a leading edge of the seed discharge voltage pulse, the the seed effect is obtained and characteristic voltage is reduced. The latter effect is also obtained even when pulse width T2 is small as shown in FIG. 2. On the other hand, when there is no seed discharge, the dependency of characteristic voltage on T2 is similar to that of the conventional element and, as shown in FIG. 2, the characteristic voltage increases with decrease in T2. The maximum seed effect, i.e., maximum reduction of discharge characteristic voltage, was observed in Td in which the seed discharge current became a maximum. Further, in the hatched region in FIG. 2, the discharge between the main discharge electrodes was extinguished when the seed discharge between the seed electrodes was extinguished. Therefore, it is clear that, in a case where the seed discharge has a memory function, the element shown in FIG. 1 has a memory function.

Emission efficiency was measured based on the ultraviolet light and the visible light converted from ultraviolet light through the phosphor while changing the pulse width T2 of voltage pulse applied between the main discharge electrodes 4 with Td being fixed to a value for which the seed discharge current becomes a maximum.

For the conventional element shown in FIG. 1, emission efficiency increases with a decrease in pulse width. It has been found that the emission efficiency obtained with a drive pulse having a width of 0.3 μsec was about four times that with a drive pulse of 2 μsec wide. However, the voltage Vs necessary to sustain a discharge was undesirably increased, causing the discharge to be unstable.

Figure 6:
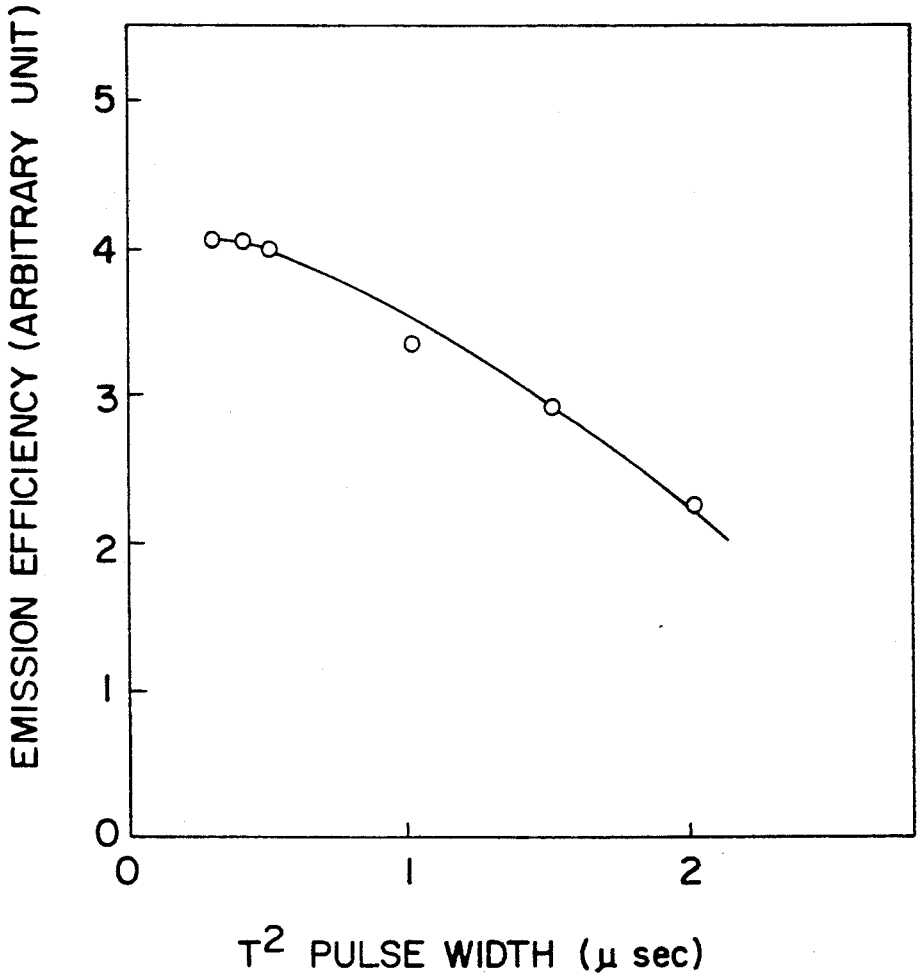
FIG. 6 is a graph showing a relation between pulse width applied to the main discharge electrodes of the embodiments of the present invention and light emission efficiency.

FIG. 6 is a graph showing a the variation of light emission efficiency of the display element according to the present invention when the drive voltage pulse width is reduced gradually. As shown in FIG. 6, when a seed discharge exists, efficiency is increased with decrease of pulse width T2 and the characteristic voltage Vf' is low and stable. With T2=0.3 μsec, the efficiency becomes twice as large as that with pulse width of 2 μsec. The overall efficiency $\eta$ of the element can be represented as follows:

$$\eta=(L1+L2)/(I1.V1+I2.V2)$$

where I1 is the seed discharge current, I2 is the main discharge current, V1 is the seed discharge voltage, V2 is the main discharge voltage, L1 is the luminance due to seed discharge and L2 is the luminance due to main discharge. It is clear from this formula that light emission efficiency depends mainly upon L2/I2·V2. Therefore, by restricting the ratio of the seed discharge to the main discharge to a sufficiently low value, it is possible to further improve the overall light emission efficiency of the element. It has been found that, by optimizing the space between the seed electrodes 2 in view of the constituents and pressure of discharge gas and by reducing the area of the electrodes, the overall efficiency obtained with a pulse width T2=0.3 μsec can be increased to about 3.5 times that obtainable with T2=2 μsec. T2 is preferably smaller than the time for which the main discharge current is reduced due to the formation of a wall charge.

Figure 8:
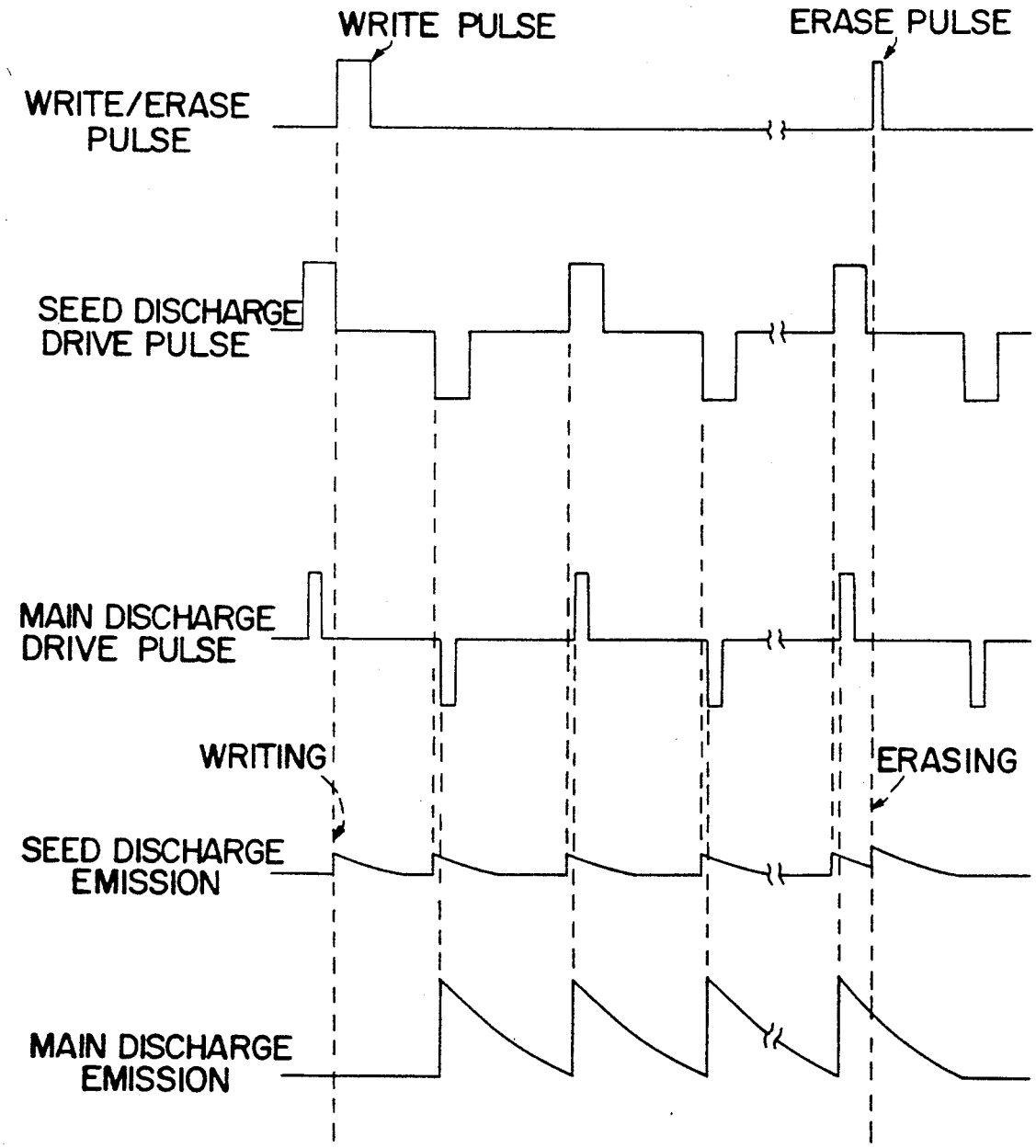
FIG. 8 is a timing chart illustration an operation of the embodiments of the present invention.

FIG. 8 is a timing chart of writing and earsing operations of the gas discharge display element shown in FIG. 3. A seed discharge drive voltage pulse whose duration is 2 μsec and a peak voltage from 0 V is 150 V is applied across the seed discharge electrodes 2 and then a main discharge voltage pulse whose duration is 0.3 μsec and a peak voltage from 0 V is 180 V is applied across the main discharge electrodes 4 at a time delayed from the leading edge of the seed voltage pulse by 0.2 μsec. For writing, a write pulse having a peak voltage of 200 V is applied to the write electrode 9 from the power source 15, so that the seed discharge is written in to start a continuous light emission. On the other hand, for erasing, a pulse whose duration is 0.5 μsec or shorter and peak voltage 200 V is applied to the electrode 9. With this erase pulse, the seed discharge is extinguished.

Figure 7:
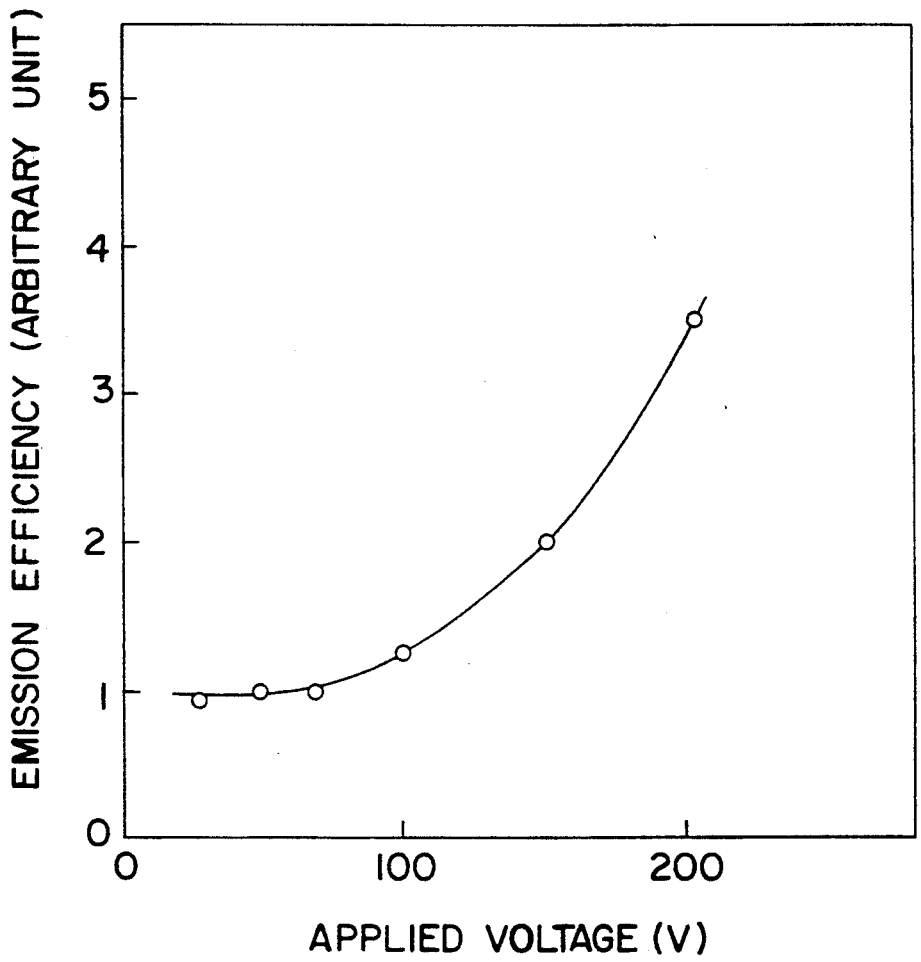
FIG. 7 is a graph showing the relation between the magnitude of voltage applied to the main discharge electrodes of embodiments of the present invention and emission strength.

With a seed discharge, the memory margin in the main discharge caused by such a drive pulse is small. When the main discharge pulse applied across the main discharge electrodes 4 is increased, emission efficiency relatively monotonically increased as shown in FIG. 7, which is contrary to that of a conventional element which has an abrupt change at a time of the discharge start pulse voltage. Therefore, by changing the value of pulse voltage applied across the main discharge electrodes 4, it is possible to obtain an element which can provide a multi-tone display.

The distance between the seed discharge electrodes 2 is preferably 0.01–0.1 mm and the pulse voltage applied thereacross has a duration of preferably 1 to 5 μsec and a magnitude of preferably 100 to 180 V. The distance between the main discharge electrodes 4 is preferably 0.05 to 0.4 mm and the pulse voltage applied thereacross has a duration of preferably 0.2 to 1 μsec and a value of preferably 100 to 180 V. The delay time Td is preferably 0.2 to 0.8 μsec.

The space between the glass substrate 1 and the front glass plate 10 is preferably 0.1 to 0.3 mm. The duration of write pulse and erase pulse applied to the write electrode 9 are preferably 1 to 5 μsec and 0.2 to 1 μsec, respectively. Each of the write and erase pulses is preferably 150 to 250 V.

Similar experiments were also conducted on various gas discharge display elements having two pairs electrodes whose constructions differ from that described hereinbefore in arrangement and size. Results showed similar effects of seed discharge and the effect of a short main discharge pulse to those obtained by the construction mentioned above. Thus, it is possible to voltage-modulate light emission strength.

Further, it has been found that these effects can be obtained even for the opposing electrode type AC gas discharge display element, as well.

What is claimed is:

1. A gas discharge display element comprising:
a first substrate;
a second substrate formed above said first substrate with a predetermined space therebetween;
a pair of first electrodes formed on said first substrate;
a first dielectric film formed on said first electrodes and on said first substrate;
a pair of second electrodes formed on said first dielectric film in the vicinity of said first electrodes;
a second dielectric film covering said second electrodes;
discharge gas filling a space defined in between said first and second substrates;
a phosphor member formed on a portion of a lower surface of said second substrate opposing said first and second electrodes pairs;
first power supply means including means for supplying a first voltage pulse to said pair of first electrodes wherein discharge produced between said pair of first electrodes indicates a memory characteristic; and
second power supply means including means for supplying a second voltage pulse to said pair of second electrodes, the second voltage pulse having a shorter width than the first voltage pulse, wherein discharge is produced between said pair of second electrodes using the discharge indicating memory characteristics as seed discharge.

2. A gas discharge display element as recited in claim 1, wherein said second voltage pulse has a width shorter than a time period during which discharge current between said second electrodes is reduced due to formation of wall charge.

3. A gas discharge display element as recited in claim 1, wherein said second power supply means comprises means for controlling the magnitude of said second voltage pulse.

4. A gas discharge display element as recited in claim 1, wherein pulse width of said first voltage pulse is 1 to 2 μsec and that of said second voltage pulse is 0.2 to 1 μsec.

5. A gas discharge display element as recited in claim 4, wherein said second voltage pulse is supplied with delay of 0.2 to 0.8 μsec from said first voltage pulse.

6. A gas discharge display element as recited in claim 4, wherein a distance between said first electrodes is 0.01 to 0.1 mm, said first voltage pulse is 100 to 180 V, a distance between said second electrodes is 0.05 to 0.4 mm and said second voltage pulse is 100 to 180 V.

7. A gas discharge display element as recited in claim 6, wherein said second voltage pulse is supplied with delay of 0.2 to 0.8 μsec from said first voltage pulse supply.

8. A gas discharge display element comprising:
a first substrate;
a second substrate formed above said first substrate with a predetermined space therebetween;
a pair of first electrodes formed on said first substrate;
a first dielectric film formed on said first electrodes and on said first substrate;
a pair of second electrodes formed on said first dielectric film in the vicinity of said first electrodes;
a second dielectric film covering said second electrodes;
discharge gas filling a space defined in between said first and second substrates;
a phosphor member formed on a portion of a lower surface of said second substrate opposing said first and second electrodes pairs;
an electrode formed on the lower surface of said second substrate;
first power supply means connected to said first electrode pair including means for applying a first voltage pulse across said first electrodes, wherein discharge produced between said first electrodes indicates a memory characteristic;
a third dielectric film formed between said electrode and said phosphor member;
second power supply means connected to said second electrode pair including means for supplying to said second electrode pair a second voltage pulse whose width is shorter than that of the first voltage pulse supplied to said first electrode pair so that discharge is produced between said second electrode pair utilizing the discharge indicating memory as seed discharge; and
third power supply means connected to said electrode including means for supplying write and erase pulses to said electrode.

9. A gas discharge display element as recited in claim 8, wherein said second power supply means comprises means for controlling the magnitude of the second voltage pulse.

10. A gas discharge display element as recited in claim 8, wherein said second voltage pulse has a width shorter than a time period during which discharge current between said second electrodes is reduced due to formation of wall a charge.

11. A gas discharge display element as recited in claim 8, wherein the width of said write pulse is 1 to 5 μsec and that of said erase pulse is 0.2 to 1 μsec.

12. A gas discharge display element as recited in claim 11, wherein the width of said first voltage pulse is 1 to 2 μsec and that of said second voltage pulse is 0.2 to 1 μsec.

13. A gas discharge display element as recited in claim 11, wherein a distance between said first and second substrates is 0.1 to 0.3 mm, said write pulse voltage is 150 to 250 V and said erase pulse voltage is 150 to 250 V.

14. A gas discharge display element as recited in claim 13, wherein a distance between said first electrodes is 0.01 to 0.1 mm, said first voltage pulse is 100 to 180 V, a distance between said second electrodes is 0.05 to 0.4 mm and said second voltage pulse is 100 to 180 V.

15. A gas discharge display element as recited in claim 14, wherein said second voltage pulse is supplied with delay of 0.2 to 0.8 μsec from said first voltage pulse.

16. A gas discharge display element comprising:
a first substrate;
a second substrate disposed opposite the first substrate with a predetermined space therebetween;

an electrode disposed on the lower surface of the second substrate;

a pair of first electrodes disposed on the first substrate;

a pair of second electrodes;

a first dielectric film disposed between the pair of first electrodes and the pair of second electrodes;

discharge gas filling the predetermined space between the electrode and the pair of second electrodes;

phosphor member disposed between the electrode and the pair of second electrodes.

17. A gas discharge display element as recited in claim 16, further comprising:

a second dielectric film disposed on the pair of second electrodes;

a third dielectric film disposed on the electrode;

wherein the phosphor member is disposed on the lower portion of the third dielectric film; and wherein the discharge gas is disposed between the phosphor member and the second dielectric film.

* * * * *